US009755346B1

(12) United States Patent
Beischer et al.

(10) Patent No.: US 9,755,346 B1
(45) Date of Patent: Sep. 5, 2017

(54) PLUG

(71) Applicant: HARTING ELECTRIC GMBH & CO. KG, Espelkamp (DE)

(72) Inventors: Thomas Beischer, Espelkamp (DE); Heiko Meier, Minden (DE)

(73) Assignee: HARTING ELECTRIC GMBH & CO. KG (DE)

( * ) Notice: Subject to any disclaimer, the term of this patent is extended or adjusted under 35 U.S.C. 154(b) by 0 days.

(21) Appl. No.: 15/310,046

(22) PCT Filed: Jul. 1, 2015

(86) PCT No.: PCT/DE2015/100274

§ 371 (c)(1),
(2) Date: Nov. 9, 2016

(87) PCT Pub. No.: WO2016/012001

PCT Pub. Date: Jan. 28, 2016

(30) Foreign Application Priority Data

Jul. 22, 2014 (DE) ..... 10 2014 110 279

(51) Int. Cl.
*H01R 13/44* (2006.01)
*H01R 13/645* (2006.01)
*H01R 13/627* (2006.01)

(52) U.S. Cl.
CPC ..... *H01R 13/44* (2013.01); *H01R 13/627* (2013.01); *H01R 13/645* (2013.01)

(58) Field of Classification Search
CPC ..... H01R 13/44
See application file for complete search history.

(56) References Cited

U.S. PATENT DOCUMENTS

| | | | | |
|---|---|---|---|---|
| 4,927,374 | A | 5/1990 | Batty | 439/310 |
| 5,378,168 | A | 1/1995 | Sumida | 439/358 |
| 6,364,718 | B1 | 4/2002 | Polgar et al. | 439/680 |
| 6,641,436 | B2 * | 11/2003 | Baffert | H01R 9/0518 439/582 |
| 6,641,437 | B2 * | 11/2003 | Tsuji | H01R 13/4223 439/595 |
| 7,101,192 | B1 * | 9/2006 | Bordeau | H01R 13/4364 439/66 |

(Continued)

FOREIGN PATENT DOCUMENTS

| | | | |
|---|---|---|---|
| DE | 202010009298 | 12/2011 | H01R 13/645 |
| EP | 1670099 | 6/2006 | H01R 13/44 |

OTHER PUBLICATIONS

German Office Action (no translation) issued in application No. 10 2014 110 279.7, dated Mar. 20, 2015 (5 pgs).

(Continued)

*Primary Examiner* — James Harvey
(74) *Attorney, Agent, or Firm* — Hayes Soloway P.C.

(57) ABSTRACT

Provided is a plug having a first plug piece and a second plug piece. The plug pieces are designed to enter in contact with each other, a male end of plug piece being accommodated in a first female end of plug piece. When the first plug piece is in contact with the second plug piece, electric contact elements accommodated in the plug pieces are in contact with each other. An insert accommodated in the female end of the first plug piece prevents inadvertent contacts by foreign bodies in the female end.

3 Claims, 4 Drawing Sheets

(56) References Cited

U.S. PATENT DOCUMENTS

| | | | | |
|---|---|---|---|---|
| 2011/0053404 | A1 | 3/2011 | Tsuruta et al. | 439/345 |
| 2016/0329651 | A1* | 11/2016 | Yamaguchi | H01R 11/12 |

OTHER PUBLICATIONS

International Search Report (with translation) and Written Opinion (no translation) issued in application No. PCT/DE2015/100274, dated Oct. 5, 2015 (12 pgs).
International Preliminary Report on Patentability issued in application No. PCT/DE2015/100274, dated Feb. 2, 2017 (8 pgs).

* cited by examiner

PLUG

BACKGROUND OF THE INVENTION

The invention is based on a plug-in connector.

Such plug-in connectors are required to connect electrical lines or cables to each other. Plug-in connectors in this case usually consist of two connector parts that are designed for mutual contacting and latching.

The connector parts in this case usually have an insulating carrier body, which either also serves as a housing or which is additionally accommodated in a housing. The two connector parts are realized so as to correspond, such that they can be inserted in one another.

Accommodated in the insulating bodies are electrical contact elements that are likewise realized so as to correspond, in order to contact with each other. Connected to the electrical contact elements, on the back side, are the electrical lines or the cable that are to be electronically contacted with each other.

There is a great variety of plug-in connectors known from the prior art. These plug-in connectors are differentiated, substantially, by their size and the number of contact elements.

A disadvantage in the case of the plug-in connectors known from the prior art is that, precisely in the case of plug-in connectors having large contact elements designed for high currents, there is no longer any protection against touching the contact elements. The larger the contact elements, the larger also are the gaps between the contact elements, and between the contact elements and the housing.

SUMMARY OF THE INVENTION

The invention is based on the object of realizing a plug-in connector such that, for special applications, it can be equipped with an anti-touch protection. This means that the contact elements of the plug-in connector are protected against unwanted touching such as, for example, by fingers of a person, or against touching by foreign bodies such as, for example, a tool.

In the case of the invention a plug-in connector consists of a first connector part and a second connector part. The connector parts in this case are realized so as to correspond. This means that the first connector part is realized such that it can accommodate, in a first plug-in side, a second plug-in side of the second connector part.

For this purpose, the first connector part has a first formed-on portion that realizes a first collar. The first collar constitutes the first plug-in side of the first connector part. The full-perimeter, first collar is provided on the first connector part such that it bounds a first free space. This means that the first free space is provided inside the first collar. The first free space in this case serves to accommodate the second plug-in side of the second connector part.

Provided on the second connector part is at least one second formed-on portion, which constitutes the second plug-in side of the second connector part. The contour of the at least one second formed-on portion in this case is shaped such that it can be accommodated in the first collar of the first connector part. The first formed-on portion and the at least one second formed-on portion in this case match, in their inner and outer contours, respectively, such that the at least one second formed-on portion can be plugged in a positive-locking manner into the first formed-on portion that constitutes the first collar.

According to the invention, the at least one second formed-on portion, that constitutes the second plug-in side of the second connector part, is shaped as a second collar. The second collar in this case bounds a second free space, on the second plug-in side. In the case of a plurality of second formed-on portions, a plurality of second free spaces may also be constituted, depending on the design of these formed-on portions.

Provided according to the present invention is an insert that can be inserted in the first free space of the first connector part. The insert in this case is preferably accommodated entirely in the first plug-in side, inside the first collar.

A preferred embodiment provides for accommodating the insert in a latchable manner in the first free space. In this case, corresponding latching means, which enable the insert to be latched in the free space, may be provided on the insert and in the first free space. Depending on the design of the latching means, it can be made possible for the insert to be repeatedly latched and released in the first free space.

The insert is constituted by a carrier element that is provided with the latching means to enable the insert to be latched in the first free space. According to the invention, at least one third formed-on portion is provided on the carrier element. In this case, the at least one third formed-on portion is attached to the insert such that it is aligned in the plug-in direction. This means that, when the insert has been inserted, and possibly latched, in the first plug-in side, the at least one third formed-on portion faces in the plug-in direction.

In a particular embodiment, the contour of the at least one third formed-on portion is shaped such that it can be accommodated in the at least one second collar of the second connector part. The at least one second formed-on portion and the at least one third formed-on portion in this case match in their inner and outer contours, respectively, such that the at least one third formed-on portion can be plugged in a positive-locking manner into the at least one second formed-on portion that constitutes the at least one second collar.

According to the invention, the two connector parts have a first and a second contact element, which are accommodated in the connector parts. The contact elements in this case are held mechanically in the connector parts. A plug-in side of the contact elements projects, respectively, into the first and second plug-in side of the first and second connector parts.

The plug-in sides of the contact elements are likewise realized so as to correspond, such that they can be simultaneously contacted with the connector parts. In this case, the plug-in side of the first contact element is realized as a pin contact, and the plug-in side of the second contact element is realized as a socket contact. In a particularly preferred embodiment, the contact tip of the first contact element is made of an insulating material. The insulating contact tip serves to protect against unwanted electrical contact with the contact element by objects.

Expediently, the insert has an opening, which enables the first contact element to be led through the insert. The insert, with its at least one third formed-on portion, fulfills the purpose that the first free space of the first connector part is filled, and unwanted electrical contacting by object or body parts such as, e.g. fingers, is prevented.

The design, according to the invention, of the first, second and third formed-on portions prevents foreign bodies from entering the first free space, and thus avoids incorrect electrical contact. Nevertheless, contacting of the first connector part with the second connector part is possible, owing to the nesting of the formed-on portions.

BRIEF DESCRIPTION OF THE DRAWINGS

An exemplary embodiment of the invention is represented in the drawings and explained in greater detail in the following. There are shown in.

The figures contain partly simplified, schematic representations. In part, elements that are the same, but possibly not identical, are denoted by identical references. Differing views of elements that are the same may differ in scale.

DETAILED DESCRIPTION OF THE INVENTION

Figure 1:
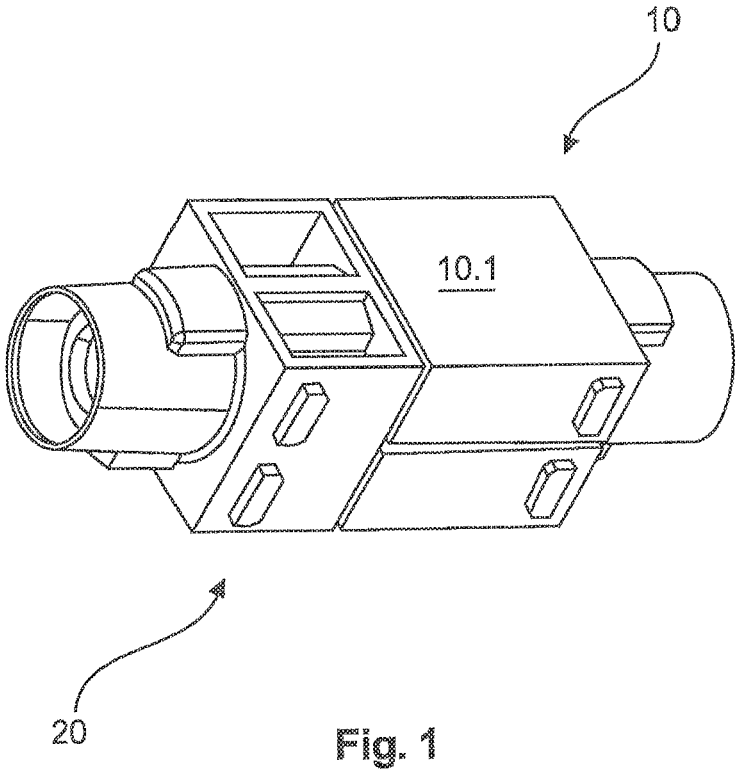
FIG. 1 a plug-in connector according to the invention.

FIG. 1 shows a plug-in connector in a perspective representation. The plug-in connector consists of a first connector part 10 and a second connector part 20. In this exemplary embodiment, the connector parts 10, 20 plug-in connector modules, designed for use in a modular plug-in connector.

The first connector part 10 has, at its end that is located in the plug-in direction, a first plug-in side 10.1. The first plug-in side 10.1 is realized such that a second plug-in side 20.1 of the second connector part 20 is accommodated therein.

Figure 2:
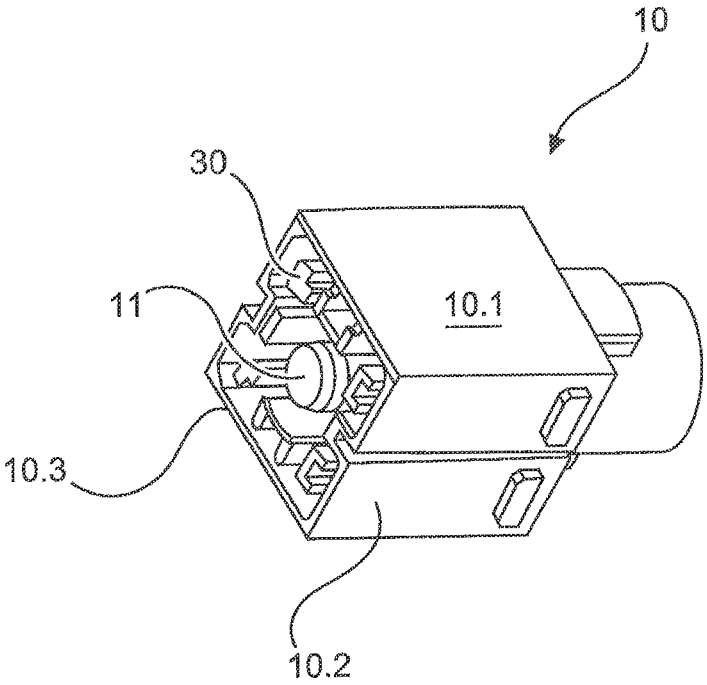
FIG. 2 a first connector part, having an insert and a first contact element, FIG. 3 a separated first connector part, FIG. 4 a separated insert, FIG. 5 a separated second connector part, FIG. 6 a cross section of a plug-in connector according to the invention, FIG. 7 a separated first formed-on portion, FIG. 8 a separated second formed-on portion, and FIG. 9 a separated third formed-on portion.

The first connector part 10 is shown in FIG. 2. A first contact element 11 is accommodated centrally in the first connector part 10. The first contact element 11 projects, by a plug-in end, into the first plug-in side 10.1 of the connector part 10.

The first plug-in side 10.1 of the connector part 10 is constituted by a first formed-on portion 10.2. The first formed-on portion 10.2 in this case constitutes a full-perimeter, first collar 10.3. At the same time, in this case the first formed-on portion 10.2 constitutes the housing of the connector part 10.

The first contact element 11 is visible inside the first collar 10.3. An insert 30 is provided in the intermediate region between the first collar 10.3 and the first contact element 11. The insert 30 prevents foreign bodies such as small parts, or also a finger of a person, from being able to enter the gap and cause an electrical short circuit.

Figure 3:
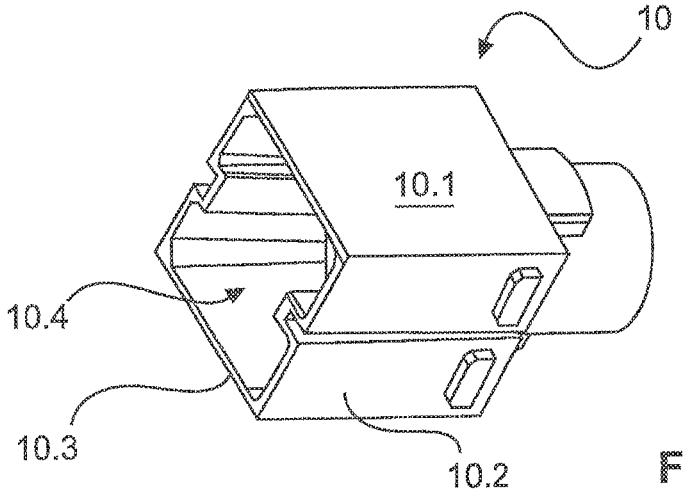

The first connector part 10 From FIGS. 1 and 2 is shown again, in separated form, in FIG. 3. It can be seen here that the first formed-on portion 10.2 constitutes the first collar 10.3. The first collar 10.3 in this case surrounds a first free space 10.4 in the plug-in side 10.1 of the connector part 10. The first free space 10.4 serves to accommodate the first contact element 11 and the insert 30.

Figure 4:
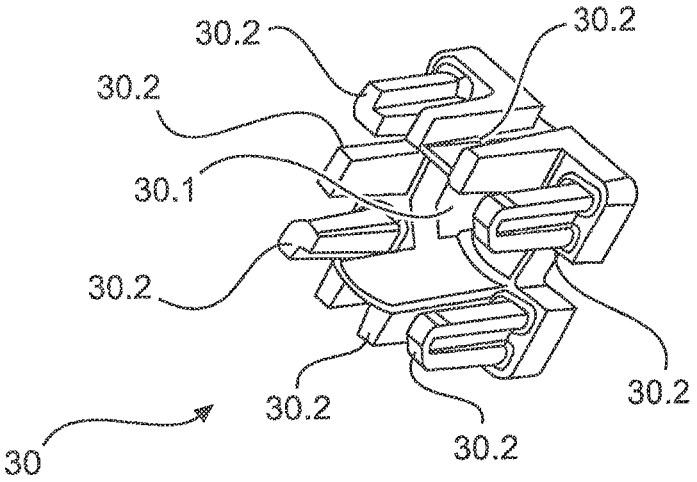

Such an insert 30 is represented in separated form in FIG. 4. The insert 30 consists substantially of a multiplicity of—here seven—third formed-on portions 30.2. The third formed-on portions 30.2 are disposed around an opening 30.1. The opening 30.1 serves subsequently to lead through the first contact element 11.

The third formed-on portions 30.2 are formed onto a base of the insert 30. The base serves at the same time for latching the insert 30 in the first free space 10.4 of the first connector part 10.

Figure 5:
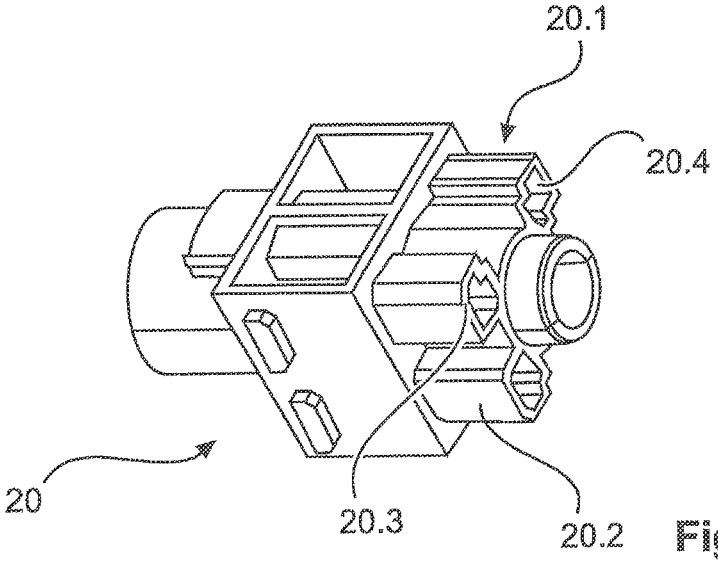

A second connector part 20 of the plug-in connector is shown in FIG. 5. The perspective representation provides a view of the plug-in side of the connector part 20 that constitutes a second plug-in side 20.1. According to the invention, the second plug-in side 20.1 consists of second formed-on portions 20.2 The latter extend in the plug-in direction.

The second formed-on portions 20.2 are disposed such that they constitute a plurality of second collars 20.3. The second collars 20.3 are disposed in the second plug-in side 20.1 such that they surround a plurality of—here five—second free spaces 20.4. The second free spaces 20.4 serve, in the case of contacting the first connector part 10 with the second connector part 20, to accommodate the third formed-on portions 30.2 of the insert 30.

The middle second free space 20.4 is designed to accommodate a second contact element 21 in the second connector part 20. In the contacted state, the contact region of the first contact element 11 is additionally accommodated in the second free space 20.4.

Figure 6:
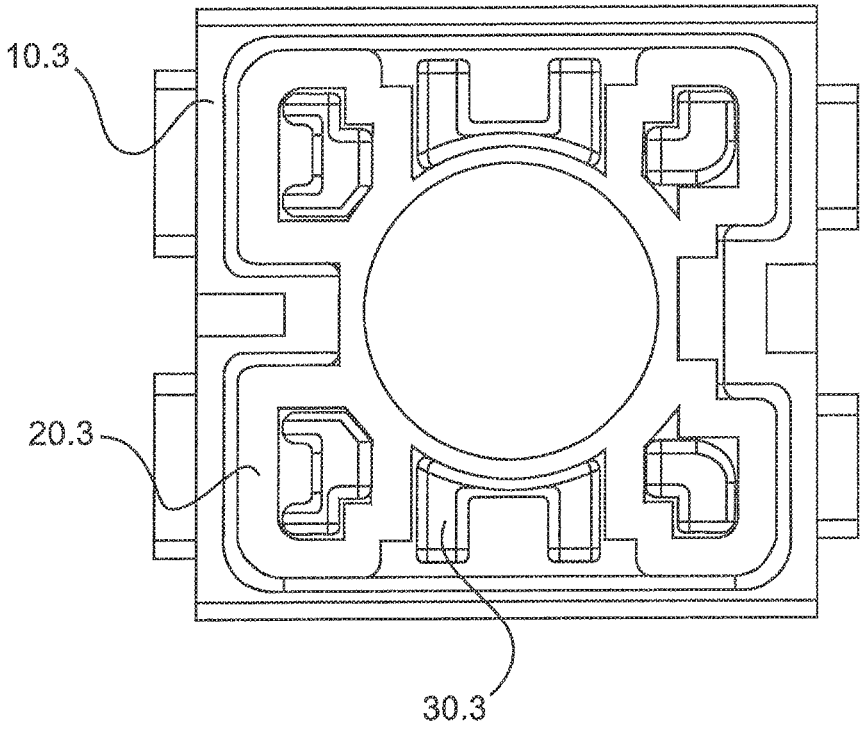

The interaction, according to the invention, between the first collar 10.3, the second collar 20.3 and the third formed-on portions 30.2 is represented in FIG. 6. This shows a cross section through the first plug-in side 10.1 and the second plug-in side 20.1 of two contacted connector parts 10, 20.

The contours of the first collar 10.3 that encompasses all other parts, in the outer region, can be seen. The contour of the second collar 20.3 adjoins the inside of the first collar 10.3 in a positive-locking manner. The free spaces 20.4 between the second collar 20.3 are again filled, in a positive-locking manner, with the third formed-on portions 30.2.

Figure 7:
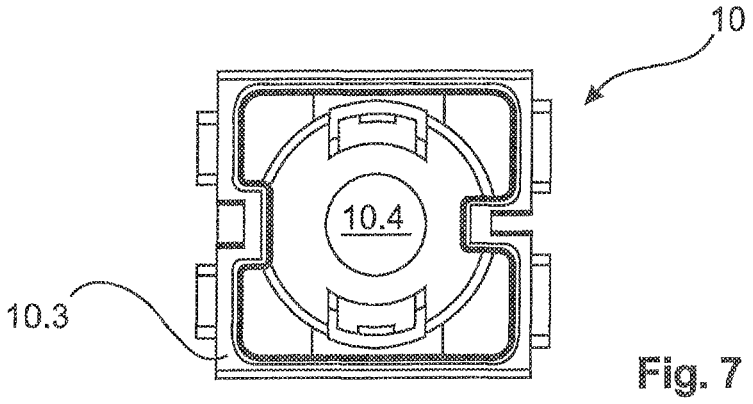
Figure 8:
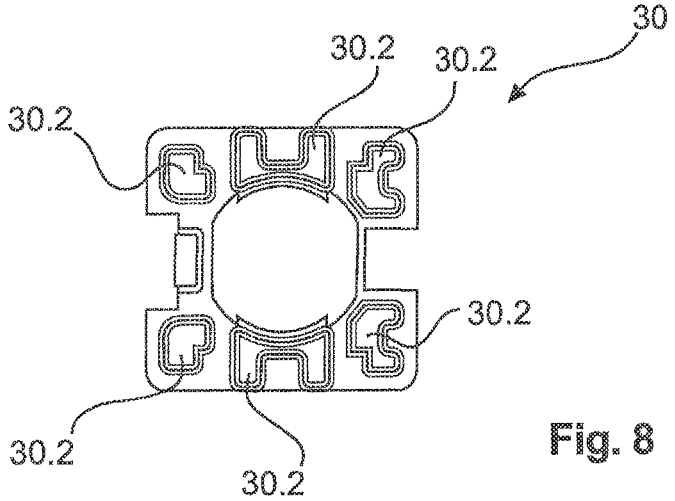
Figure 9:
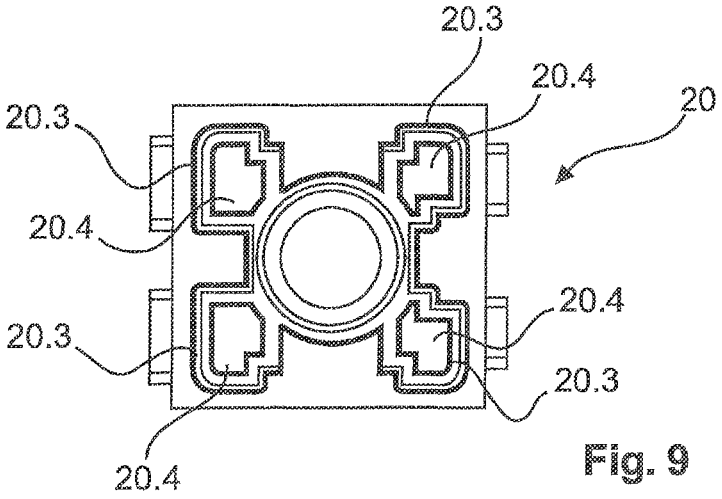

The contours of the formed-on portion 10.2, the second formed-on portion 20.2 and the third formed-on portion 30.2 are represented again, in separated form, in FIGS. 7, 8 and 9.

LIST OF REFERENCES

10 first connector part
10.1 first plug-in side
10.2 first formed-on portion
10.3 first collar
10.4 first free space
11 first contact element
11.1 contact tip
20 second connector part
20.1 second plug-in side
20.2 second formed-on portion
20.3 second collar
20.4 second free space
21 second contact element
30 insert
30.1 opening
30.2 third formed-on portion

The invention claimed is:

1. A plug-in connector, having a first connector part and a corresponding second connector part, and at least two corresponding contact elements accommodated in the first and second connector parts, wherein:

the first connector part has a first plug-in side that is constituted by a first formed-on portion, the first formed-on portion is constituted by a full-perimeter, first collar, which bounds a first free space, and the first contact element is disposed inside the first collar, the second connector part has a second plug-in side that is constituted by at least one second formed-on portion, and the second contact element is disposed inside the at least one second formed-on portion, the contour of the at least one second formed-on portion matches the contour of the first collar such that the at least one second formed-on portion can be accommodated in a positive-locking manner inside the first collar, and the at least one second formed-on portion is realized as a second collar, wherein the second collar, which constitutes the at least one second formed-on portion, bounds a second free space, wherein:

the first contact element, at its contact tip that faces in the plug-in direction, is composed of an insulating material, an insert is provided, which can be inserted in the first free space of the first plug-in side of the first connector part, the insert can be latched in the first free space of the first connector part, the insert has at least one third formed-on portion, and the at least one third formed-on portion is aligned in the plug-in direction, and the at least one third formed-on portion matches the contour of the second collar such that the at least one third formed-on portion can be disposed in a positive-locking manner in the second free space, inside the second collar.

2. The plug-in connector as claimed in claim 1, wherein the insert has an opening which serves to lead through the first contact element.

3. A plug-in connector, having a first connector part and a corresponding second connector part, and at least two corresponding contact elements accommodated in the first and second connector parts, wherein:

the first connector part has a first plug-in side that is constituted by a first formed-on portion, the first formed-on portion is constituted by a full-perimeter, first collar, which hounds a first free space, and the first contact element is disposed inside the first collar, the second connector part has a second plug-in side that is constituted by at least one second formed-on portion, and the second contact element is disposed inside the at least one second formed-on portion, the contour of the at least one second formed-on portion matches the contour of the first collar such that the at least one second formed-on portion can be accommodated in a positive-locking manner inside the first collar, and the at least one second formed-on portion is realized as a second collar, wherein the second collar, which constitutes the at least one second formed-on portion, bounds a second free space, wherein:

an insert is provided, which can be inserted in the first free space of the first plug-in side of the first connector part, wherein the insert has an opening which serves to lead through the first contact element, the first contact element, at its contact tip that faces in the plug-in direction, is composed of an insulating material, the insert can be latched in the first free space of the first connector part, the insert has at least one third formed-on portion, and the at least one third formed-on portion is aligned in the plug-in direction, and the at least one third formed-on portion matches the contour of the second collar such that the at least one third formed-on portion can be disposed in a positive-locking manner in the second free space, inside the second collar.

* * * * *